US009285099B2

(12) United States Patent
Pickard et al.

(10) Patent No.: US 9,285,099 B2
(45) Date of Patent: Mar. 15, 2016

(54) PARABOLIC TROFFER-STYLE LIGHT FIXTURE

(75) Inventors: Paul Kenneth Pickard, Morrisville, NC (US); Mark D. Edmond, Raleigh, NC (US)

(73) Assignee: CREE, INC., Durham, NC (US)

( * ) Notice: Subject to any disclaimer, the term of this patent is extended or adjusted under 35 U.S.C. 154(b) by 328 days.

(21) Appl. No.: 13/453,924

(22) Filed: Apr. 23, 2012

(65) Prior Publication Data

US 2013/0279161 A1 Oct. 24, 2013

(51) Int. Cl.

| | |
|---|---|
| ***F21V 7/00*** | (2006.01) |
| ***F21V 11/06*** | (2006.01) |
| ***F21V 19/00*** | (2006.01) |
| *F21Y 101/02* | (2006.01) |
| *F21Y 103/00* | (2006.01) |

(52) U.S. Cl.

CPC ..... *F21V 7/0008* (2013.01); *F21V 11/06* (2013.01); *F21V 19/004* (2013.01); *F21Y 2101/02* (2013.01); *F21Y 2103/003* (2013.01)

(58) Field of Classification Search

CPC ..... F21V 7/00; F21V 7/0025; F21V 7/0008; F21V 19/004; F21V 11/06; F21Y 2103/003; F21Y 2101/02

USPC ..... 362/217.03, 217.04, 342, 279, 325, 362/354, 237, 241, 247, 290, 291, 292

See application file for complete search history.

(56) References Cited

U.S. PATENT DOCUMENTS

| | | | | |
|---|---|---|---|---|
| D85,382 | S | 10/1931 | Guth | D26/24 |
| 2,356,654 | A | 8/1944 | Cullman | 362/223 |
| 3,381,124 | A * | 4/1968 | Eisenberg | 362/354 |
| 4,939,627 | A | 7/1990 | Herst et al. | 362/299 |
| 5,025,356 | A | 6/1991 | Gawad | 362/221 |
| 5,823,663 | A | 10/1998 | Bell et al. | 362/362 |
| D407,473 | S | 3/1999 | Wimbock | D23/328 |
| 6,149,283 | A | 11/2000 | Conway et al. | 362/236 |

(Continued)

FOREIGN PATENT DOCUMENTS

| | | |
|---|---|---|
| CN | 1762061 | 4/2006 |
| CN | 1934389 | 3/2007 |

(Continued)

OTHER PUBLICATIONS

International Search Report and Written Opinion from PCT Application No. PCT/US2013/021053, dated Apr. 17, 2013.

(Continued)

*Primary Examiner* — Bao Q Truong

(74) *Attorney, Agent, or Firm* — Koppel, Patrick, Heybl & Philpott

(57) ABSTRACT

A parabolic troffer-style light fixture. The fixtures are sized to fit in, mount to, or suspend from a ceiling, such as being mounted in a conventional ceiling T-grid, for example. The fixture comprises a troffer housing that may be sized to fit in or rest on the T-grid, with the housing having a shape and size similar to those used for conventional fluorescent troffer lighting fixtures. The fixtures comprise a plurality of reflective louvers arranged in a grid that divides the fixture open end into a number of fixture regions with at least one functional louver providing a back side mount surface for light sources, for example, light emitting diodes. The functional louver mount surface faces a reflective back surface designed to redirect impinging light out of the fixture and into the lighted area.

27 Claims, 4 Drawing Sheets

(56) References Cited

U.S. PATENT DOCUMENTS 6,155,699 A 12/2000 Miller et al. 362/293
6,210,025 B1 4/2001 Schmidt et al. 362/362
6,234,643 B1 * 5/2001 Lichon, Jr. 362/147
6,238,064 B1 * 5/2001 Caferro 362/290
6,402,347 B1 6/2002 Maas et al. 362/294
6,443,598 B1 * 9/2002 Morgan 362/342
6,523,974 B2 2/2003 Engel 362/224
6,578,979 B2 6/2003 Truttmann-Battig 362/92
D496,121 S 9/2004 Santoro D26/74
6,871,983 B2 3/2005 Jacob et al. 362/364
6,948,840 B2 9/2005 Grenda et al. 362/555
7,021,797 B2 4/2006 Minano et al. 362/355
7,049,761 B2 5/2006 Timmermans et al. 315/246
7,063,449 B2 6/2006 Ward 345/102
7,175,296 B2 2/2007 Cok 362/147
7,213,940 B1 5/2007 Van de Ven et al. 362/231
7,217,004 B2 5/2007 Park et al. 362/240
7,237,924 B2 7/2007 Martineau et al. 362/231
D556,358 S 11/2007 Santoro D26/74
7,338,182 B1 3/2008 Hastings et al. 362/150
7,510,299 B2 3/2009 Timmermans et al. 362/225
7,520,636 B2 * 4/2009 Van Der Poel 362/290
D593,246 S 5/2009 Fowler et al. D26/76
7,559,672 B1 7/2009 Parkyn et al. 362/244
7,594,736 B1 9/2009 Kassay et al. 362/223
D604,446 S 11/2009 Fowler et al. D26/76
7,618,157 B1 11/2009 Galvez et al. 362/294
7,618,160 B2 11/2009 Chinniah et al. 362/326
D608,932 S 1/2010 Castelli D26/76
7,654,702 B1 2/2010 Ding et al. 362/294
7,661,844 B2 2/2010 Sekiguchi et al. 362/249
D611,183 S 3/2010 Duarte D26/76
7,674,005 B2 3/2010 Chung et al. 362/223
7,686,470 B2 3/2010 Chiang 362/147
7,686,484 B2 3/2010 Heiking et al. 362/375
7,712,918 B2 5/2010 Siemiet et al. 362/241
7,722,220 B2 5/2010 Van de Ven 362/294
7,722,227 B2 5/2010 Zhang et al. 362/364
D617,487 S 6/2010 Fowler et al. D26/76
7,768,192 B2 8/2010 Van de Ven et al. 313/503
7,815,338 B2 10/2010 Siemiet et al. 362/218
7,824,056 B2 11/2010 Madireddi et al. 362/125
7,828,468 B2 * 11/2010 Mayfield et al. 362/342
D633,247 S 2/2011 Kong et al. D26/88
7,922,354 B2 4/2011 Everhart 362/235
7,926,982 B2 4/2011 Liu 362/294
7,988,321 B2 8/2011 Wung et al. 362/218
7,988,335 B2 8/2011 Liu et al. 362/294
7,991,257 B1 8/2011 Coleman 264/1.24
7,993,034 B2 8/2011 Wegner 362/296.05
7,997,762 B2 * 8/2011 Wang et al. 362/249.02
8,038,314 B2 10/2011 Ladewig
8,038,321 B1 10/2011 Franck et al. 362/249.02
8,070,326 B2 12/2011 Lee 362/307
D653,376 S 1/2012 Kong et al. D26/76
8,092,043 B2 1/2012 Lin et al. 362/249.02
8,092,049 B2 1/2012 Kinnune et al. 362/294
8,096,671 B1 1/2012 Cronk 362/147
D657,488 S 4/2012 Lown et al. D26/120
8,162,504 B2 4/2012 Zhang et al. 362/217
8,186,855 B2 5/2012 Wassel et al. 362/373
8,197,086 B2 6/2012 Watanabe et al. 362/218
8,201,968 B2 6/2012 Maxik et al.
8,215,799 B2 7/2012 Vanden Eynden et al. 362/294
8,246,219 B2 8/2012 Teng et al. 362/311.03
8,256,927 B2 9/2012 Hu et al. 362/294
D670,849 S 11/2012 Lay et al. D26/74
8,317,354 B2 11/2012 Gassner et al. 362/147
D679,848 S 4/2013 Pickard et al. D26/74
8,410,514 B2 4/2013 Kim 257/99
D684,291 S 6/2013 Goelz et al. D26/74
8,480,252 B2 * 7/2013 Bertram et al. 362/243
8,506,135 B1 8/2013 Oster 362/373
8,591,058 B2 11/2013 Concepcion 362/231
8,591,071 B2 11/2013 Hochstein 362/294
D698,975 S 2/2014 Blessit et al. D26/74
8,641,243 B1 2/2014 Rashidi 362/373
D701,988 S 4/2014 Clements D26/74
8,696,154 B2 4/2014 Hutchens 362/217.05
8,702,264 B1 4/2014 Rashidi 362/147
8,764,244 B2 7/2014 Jeon 362/218
D714,988 S 10/2014 Park et al. D26/74
D721,198 S 1/2015 Glasbrenner D26/76
9,052,075 B2 6/2015 Demuynck et al.
2004/0001344 A1 1/2004 Hecht
2004/0085779 A1 5/2004 Pond et al. 362/516
2004/0240230 A1 12/2004 Kitajima 362/558
2005/0264716 A1 12/2005 Kim et al.
2005/0281023 A1 12/2005 Gould 362/217
2006/0221611 A1 10/2006 No 362/247
2006/0262521 A1 11/2006 Piepgras et al. 362/149
2006/0291206 A1 12/2006 Angelini et al. 362/244
2007/0070625 A1 3/2007 Bang 362/240
2007/0109779 A1 5/2007 Sekiguchi et al.
2007/0115670 A1 5/2007 Roberts et al.
2007/0115671 A1 5/2007 Roberts et al.
2007/0211457 A1 9/2007 Mayfield et al. 362/223
2007/0253205 A1 11/2007 Welker 362/373
2007/0297181 A1 * 12/2007 Mayfield et al. 362/342
2008/0019147 A1 1/2008 Erchak 362/607
2008/0049422 A1 2/2008 Trenchard et al. 362/238
2008/0232093 A1 9/2008 Kim 362/147
2008/0278943 A1 * 11/2008 Van Der Poel 362/240
2009/0034247 A1 2/2009 Boyer 362/225
2009/0073693 A1 3/2009 Nall 362/249.02
2009/0161356 A1 6/2009 Negley et al. 362/231
2009/0168439 A1 7/2009 Chiang 362/404
2009/0196024 A1 8/2009 Heiking et al. 362/150
2009/0225543 A1 9/2009 Roberts et al.
2009/0237958 A1 9/2009 Kim
2009/0262543 A1 10/2009 Ho 362/373
2009/0296388 A1 12/2009 Wu et al. 362/235
2009/0310354 A1 12/2009 Zampini et al. 362/235
2009/0323334 A1 12/2009 Roberts et al.
2010/0061108 A1 3/2010 Zhang et al. 362/364
2010/0097794 A1 4/2010 Teng et al. 362/231
2010/0103678 A1 4/2010 Van de Ven et al. 362/294
2010/0110679 A1 5/2010 Teng et al.
2010/0172133 A1 7/2010 Lie 362/235
2010/0177532 A1 7/2010 Simon et al. 362/555
2010/0188609 A1 7/2010 Matsuki et al.
2010/0253591 A1 10/2010 Hwu et al. 345/1.3
2010/0254128 A1 10/2010 Pickard et al. 362/231
2010/0254145 A1 10/2010 Yamaguchi
2010/0254146 A1 10/2010 McCanless
2010/0270903 A1 10/2010 Jao et al. 313/46
2010/0271843 A1 10/2010 Holten et al. 362/609
2010/0277905 A1 11/2010 Janik et al. 362/235
2010/0295468 A1 11/2010 Pederson et al. 315/294
2010/0327768 A1 12/2010 Kong et al. 315/294
2011/0032714 A1 2/2011 Chang 362/373
2011/0043132 A1 2/2011 Kim et al.
2011/0090671 A1 * 4/2011 Bertram et al. 362/84
2011/0141722 A1 6/2011 Acampora et al. 362/218
2011/0141734 A1 6/2011 Li et al. 362/235
2011/0156584 A1 6/2011 Kim 315/32
2011/0164417 A1 7/2011 Huang 362/235
2011/0175533 A1 7/2011 Homan 315/130
2011/0199005 A1 8/2011 Bretschneider et al.
2011/0199769 A1 8/2011 Bretschneider et al.
2011/0246146 A1 10/2011 Kauffman et al. 703/2
2011/0255292 A1 10/2011 Shen 362/311
2011/0267810 A1 11/2011 Higman et al. 362/218
2011/0267823 A1 11/2011 Angelini et al. 362/277
2011/0305024 A1 12/2011 Chang 362/294
2012/0033420 A1 2/2012 Kim et al. 362/235
2012/0038289 A1 2/2012 Jee et al. 315/291
2012/0051041 A1 3/2012 Edmond et al. 362/231
2012/0127714 A1 5/2012 Rehn
2012/0134146 A1 5/2012 Smith 362/225
2012/0140442 A1 6/2012 Woo 362/95
2012/0140461 A1 6/2012 Huang et al.
2013/0235568 A1 9/2013 Green et al. 362/218

(56) References Cited

U.S. PATENT DOCUMENTS

| | | | | |
|---|---|---|---|---|
| 2013/0258652 | A1 | 10/2013 | Hsieh | 362/225 |
| 2014/0265930 | A1 | 9/2014 | Harris | 315/307 |
| 2015/0016100 | A1 | 1/2015 | Ishii | 362/223 |

FOREIGN PATENT DOCUMENTS

| | | | |
|---|---|---|---|
| CN | 1963289 | A | 5/2007 |
| CN | 101188261 | | 5/2008 |
| CN | 101660715 | | 3/2010 |
| CN | 10177625 4 | | 7/2010 |
| CN | 10179066 0 | | 7/2010 |
| CN | 102072443 | | 5/2011 |
| CN | 202580962 | | 12/2012 |
| DE | 102007030186 | | 1/2009 |
| DE | 202010001832 | | 7/2010 |
| EP | 1298383 | A2 | 4/2003 |
| EP | 1357335 | A2 | 10/2003 |
| EP | 1653254 | | 3/2006 |
| EP | 1737051 | | 12/2006 |
| EP | 1847762 | A2 | 10/2007 |
| EP | 1860467 | | 11/2007 |
| EP | 2636945 | A2 | 9/2013 |
| JP | 2002244027 | | 11/2002 |
| JP | U3097327 | | 8/2003 |
| JP | 2004140327 | | 5/2004 |
| JP | 2004345615 | | 12/2004 |
| JP | 2006173624 | | 6/2006 |
| JP | 2009295577 | | 12/2009 |
| JP | 2010103687 | | 5/2010 |
| JP | 2011018571 | | 8/2011 |
| JP | 2011018572 | | 8/2011 |
| TW | 201018826 | | 5/2010 |
| WO | WO 03102467 | | 12/2003 |
| WO | WO03102467 | | 12/2003 |
| WO | WO2009030233 | | 3/2009 |
| WO | WO2009140761 | A1 | 11/2009 |
| WO | WO 2009157999 | | 12/2009 |
| WO | WO2009157999 | A1 | 12/2009 |
| WO | WO 2010024583 | | 3/2010 |
| WO | WO2010042216 | | 4/2010 |
| WO | WO2010042216 | A2 | 4/2010 |
| WO | WO2011074424 | A1 | 6/2011 |
| WO | WO2011096098 | A1 | 8/2011 |
| WO | WO2011098191 | | 8/2011 |
| WO | WO2011118991 | A2 | 9/2011 |
| WO | WO2011140353 | A2 | 11/2011 |

OTHER PUBLICATIONS

Notice to Submit a Response from Korean Patent Application No. 30-2011-0038115, dated Dec. 12, 2012.
Notice to Submit a Response from Korean Patent Application No. 30-2011-0038116, dated Dec. 12, 2012.
Search Report and Written Opinion from PCT Patent Appl. No. PCT/US2012/047084, dated Feb. 27, 2013.
Search Report and Written Opinion from PCT Patent Appl. No. PCT/US2012/071800, dated Mar. 25, 2013.
Office Action from U.S. Appl. No. 29/387,171, dated May 2, 2012.
Response to OA from U.S. Appl. No. 29/387,171, filed Aug. 2, 2012.
Office Action from U.S. Appl. No. 12/961,385, dated Apr. 26, 2013.
Response to OA from U.S. Appl. No. 12/961,385, filed Jul. 24, 2013.
Office Action from U.S. Appl. No. 13/464,745, dated Jul. 16, 2013.
Office Action from U.S. Appl. No. 29/368,970, dated Jun. 19, 2012.
Office Action from U.S. Appl. No. 29/368,970, dated Aug. 24, 2012.
Response to OA from U.S. Appl. No. 29/368,970, filed Nov. 26, 2012.
International Search Report and Written Opinion for PCT Application No. PCT/US2011/062396, dated Jul. 13, 2012.
Final Rejection issued in Korean Design Appl. No. 30-2011-0038114, dated Jun. 14, 2013.
Final Rejection issued in Korean Design Appl. No. 30-2011-0038115, dated Jun. 14, 2013.
Final Rejection issued in Korean Design Appl. No. 30-2011-0038116, dated Jun. 17, 2013.
International Search Report and Written Opinion from PCT Patent Appl. No. PCT/US2013/035668, dated Jul. 12, 2013.
U.S. Appl. No. 12/873,303, filed Aug. 31, 2010 to Edmond, et al.
U.S. Appl. No. 12/961,385, filed Dec. 6, 2010 to Pickard, et al.
Cree's XLamp XP-E LED's, data sheet, pp. 1-16.
Cree's XLamp XP-G LED's, data sheet, pp. 1-12.
Office Action from Japanese Design Patent Application No. 2011-18570.
Reason for Rejection from Japanese Design Patent Application No. 2011-18571.
Reason for Rejection from Japanese Design Patent Application No. 2011-18572.
International Search Report and Written Opinion for Patent Application No. PCT/US2011/001517, dated: Feb. 27, 2012.
International Search Report and Written Opinion from PCT/US2013/049225, dated Oct. 24, 2013.
Preliminary Report and Written Opinion from PCT appl. No. PCT/US2012/047084, dated Feb. 6, 2014.
Office Action from U.S. Appl. No. 13/429,080, dated Apr. 18, 2014.
Office Action from U.S. Appl. No. 12/961,385, dated Mar. 11, 2014.
Office Action from U.S. Appl. No. 13/464,745, dated Feb. 12, 2014.
Office Action from U.S. Appl. No. 13/341,741, dated Jan. 14, 2014.
Office Action from U.S. Appl. No. 13/370,252, dated Dec. 20, 2013.
International Search Report and Written Opinion from Appl. No. PCT/CN2013/072772, dated Dec. 19, 2013.
Office Action from U.S. Appl. No. 13/464,745, dated Jul. 16, 2014.
International Preliminary Report on Patentability and Written Opinion from PCT/US2013/021053, dated Aug. 21, 2014.
International Preliminary Report on Patentabiliby from PCT/US2012/071800 dated Jul. 10, 2014.
Office Action from U.S. Appl. No. 13/189,535, dated Jun. 20, 2014.
Office Action from U.S. Appl. No. 13/443,630, dated Jul. 1, 2014.
Reasons for Rejection from Japanese Patent Appl. No. 2013-543207, dated May 20, 2014.
First Office Action from Chinese Patent Appl. No. 2011800529984, dated May 4, 2014.
Office Action from U.S. Appl. No. 13/544,662, dated May 5, 2014.
Office Action from U.S. Appl. No. 13/844,431, dated May 15, 2014.
Office Action from U.S. Appl. No. 13/341,741, dated Jun. 6, 2014.
Communication from European Patent Appl. No. 13701525.1-1757, dated Sep. 26, 2014.
Office Action from U.S. Appl. No. 13/787,727, dated Jan. 29, 2015.
Office Action from U.S. Appl. No. 13/429,080, dated Feb. 18, 2015.
First Official Action from European Patent Appl. No. 12 743 003.1-1757, dated Jan. 16, 2015.
First Office Action from Chinese Patent Appl. No. 2012800369142, dated Mar. 26, 2015.
Office Action from U.S. Appl. No. 13/464,745, dated Apr. 2, 2015.
Office Action from U.S. Appl. No. 13/442,746, dated Apr. 28, 2015.
Office Action from U.S. Appl. No. 13/368,217, dated May 13, 2015.
Office Action from U.S. Appl. No. 13/828,348, dated May 27, 2015.
Office Action from U.S. Appl. No. 13/429,080, dated Sep. 1, 2015.
Office Action from U.S. Appl. No. 14/716,480, dated Sep. 24, 2015.
Office Action from U.S. Appl. No. 14/170,627, dated Oct. 5, 2015.
Office Action from U.S. Appl. No. 13/368,217, dated Oct. 8, 2015.
Office Action from U.S. Appl. No. 13/464,745, dated Oct. 8, 2015.
Office Action from U.S. Appl. No. 29/466,391, dated Oct. 14, 2015.
Decision of Rejection from Japanese Appl. No. 2013-543207, dated Nov. 25, 2014.
Office Action from Mexican Appl. No. 100881, dated Nov. 28, 2014.
Grant Notice from European Appl. No. 13701525.1-1757, dated Nov. 24, 2014.
Preliminary Report on Patentability from PCT/US2013/035668, dated Oct. 14, 2014.
Office Action from U.S. Appl. No. 13/442,746, dated Sep. 15, 2014.
Office Action from U.S. Appl. No. 13/429,080, dated Sep. 16, 2014.
Office Action from U.S. Appl. No. 13/844,431, dated Oct. 10, 2014.
Office Action from U.S. Appl. No. 13/443,630, dated Oct. 10, 2014.
Office Action from U.S. Appl. No. 13/368,217, dated Oct. 22, 2014.
Office Action from U.S. Appl. No. 12/961,385, dated Nov. 6, 2014.

(56) References Cited

OTHER PUBLICATIONS

Second Office Action and Search Report from Chinese Appl. No. 2011800529984, dated Dec. 26, 2014.
Grant Notice from European Appl. No. 13701525.1, dated Nov. 19, 2014.
International Report and Written Opinion from PCT/US2013/049225, dated Jan. 22, 2015.
Office Action from U.S. Appl. No. 13/828,348, dated Nov. 20, 2014.
Office Action from U.S. Appl. No. 12/873,303, dated Nov. 28, 2014.
Office Action from U.S. Appl. No. 13/464,745, dated Dec. 10, 2014.
Office Action from U.S. Appl. No. 13/341,741, dated Dec. 24, 2014.
Office Action from U.S. Appl. No. 13/189,535, dated Jan. 13, 2015.
Notice of Completion of Pretrial Re-examination from Japanese Patent appl. No. 2013-543207, dated Jun. 30, 2015.
Pretrial Report from Japanese Appl. No. 2013-543207, dated Jun. 19, 2015.
Decision of Rejection from Chinese Patent Appl. No. 201180052998.4, dated Jul. 16, 2015.
Office Action from U.S. Appl. No. 12/873,303, dated Jun. 22, 2015.
Response to OA from U.S. Appl. No. 12/873,303, filed Aug. 21, 2015.
Office Action from U.S. Appl. No. 13/341,741, dated Jun. 22, 2015.
Office Action from U.S. Appl. No. 13/443,630, dated Jun. 23, 2015.
Response to OA from U.S. Appl. No. 13/443,630, filed Aug. 21, 2015.
Office Action from U.S. Appl. No. 13/189,535, dated Jul. 14, 2015.
Office Action from U.S. Appl. No. 13/442,746, dated Jul. 27, 2015.
Office Action from U.S. Appl. No. 14/020,757, dated Aug. 3, 2015.
Office Action from U.S. Appl. No. 12/961,385. dated Nov. 27, 2015.
Office Action from U.S. Appl. No. 13/828,348. dated Nov. 4, 2015.
Office Action from U.S. Appl. No. 14/020,757. dated Nov. 24. 2014.
First Office Action from Chinese Patent Appl. No. 2011800588770, dated Sep. 25, 2015.

* cited by examiner

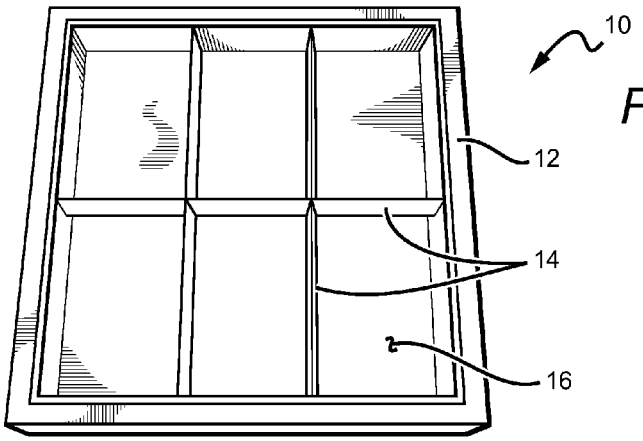
FIG. 1
FIG. 2
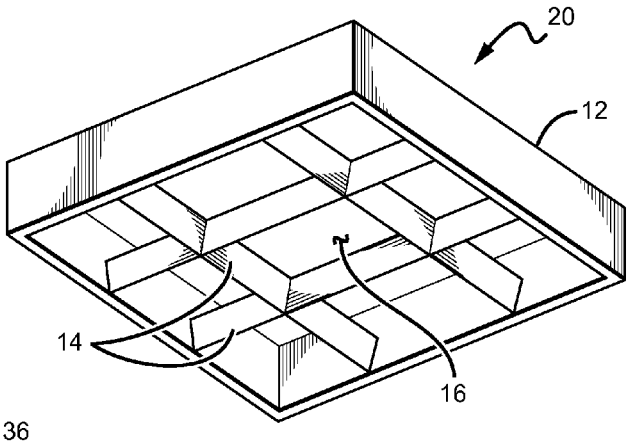
FIG. 3
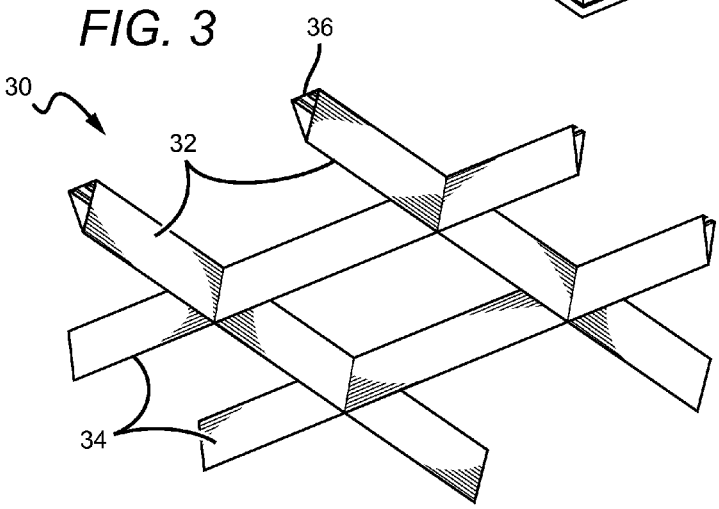

FIG. 6
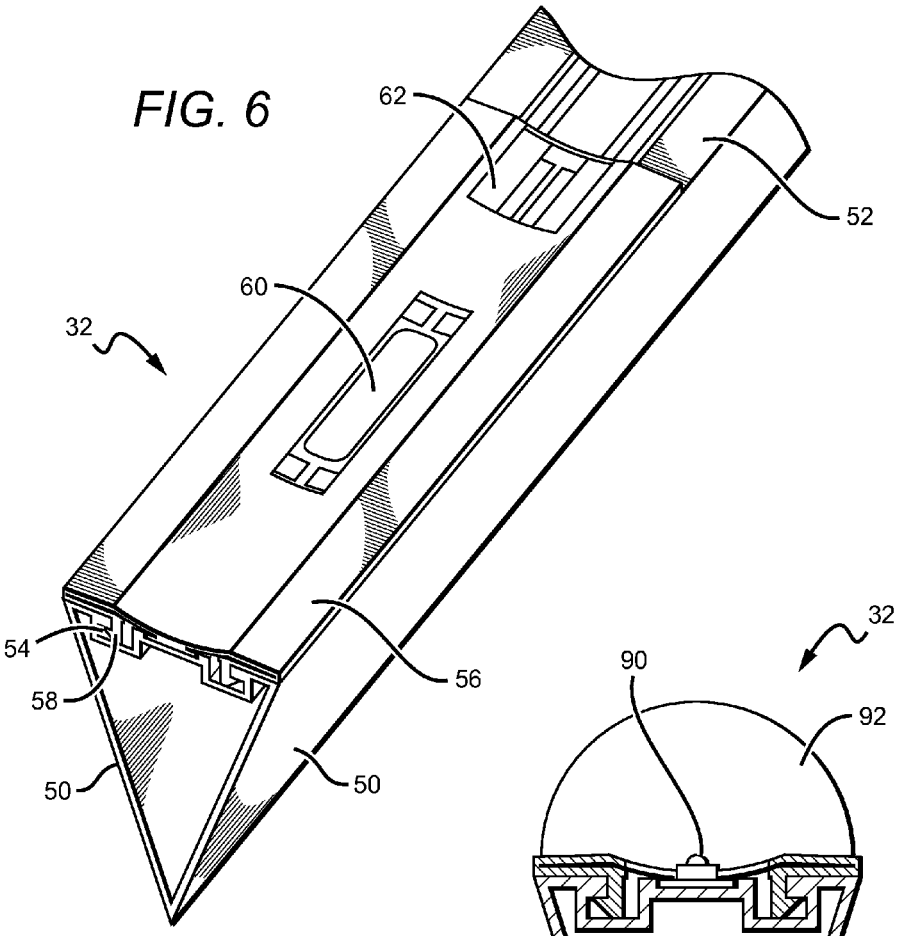
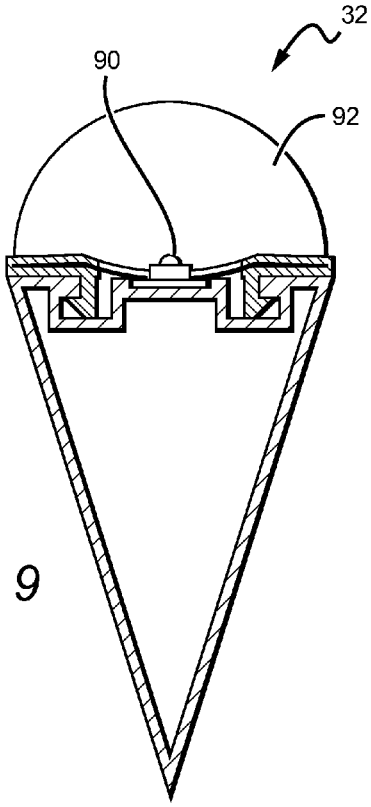
FIG. 9

PARABOLIC TROFFER-STYLE LIGHT FIXTURE

BACKGROUND OF THE INVENTION

1. Field of the Invention

The invention relates to troffer-style lighting fixtures, and more particularly, to indirect troffer-style lighting fixtures utilizing solid state light sources.

2. Description of the Related Art

Troffer-style fixtures are ubiquitous in commercial office and industrial spaces throughout the world. In many instances these troffers house elongated fluorescent light bulbs that span the length of the troffer. Troffers may be mounted to or suspended from ceilings, such as being suspended by a "T-grid". Often the troffer may be recessed into the ceiling, with the back side of the troffer (i.e. troffer pan) protruding into the plenum area above the ceiling a distance of up to six inches or more. In other arrangements, elements of the troffer on the back side dissipate heat generated by the light source into the plenum where air can be circulated to facilitate the cooling mechanism. U.S. Pat. No. 5,823,663 to Bell, et al. and U.S. Pat. No. 6,210,025 to Schmidt, et al. are examples of typical troffer-style fixtures. These fixtures can require a significant amount of ceiling space to operate properly. Many of these fixtures utilize a grid of louvers to more evenly distribute the light and reduce glare.

More recently, with the advent of the efficient solid state lighting sources, these troffers have been used with solid state light sources, such as light emitting diodes (LEDs). LEDs are solid state devices that convert electric energy to light and generally comprise one or more active regions of semiconductor material interposed between oppositely doped semiconductor layers. When a bias is applied across the doped layers, holes and electrons are injected into the active region where they recombine to generate light. Light is produced in the active region and emitted from surfaces of the LED.

LEDs have certain characteristics that make them desirable for many lighting applications that were previously the realm of incandescent or fluorescent lights. Incandescent lights are very energy-inefficient light sources with approximately ninety percent of the electricity they consume being released as heat rather than light. Fluorescent light bulbs are more energy efficient than incandescent light bulbs by a factor of about 10, but are still relatively inefficient. LEDs by contrast, can emit the same luminous flux as incandescent and fluorescent lights using a fraction of the energy.

In addition, LEDs can have a significantly longer operational lifetime. Incandescent light bulbs have relatively short lifetimes, with some having a lifetime in the range of about 750-1000 hours. Fluorescent bulbs can also have lifetimes longer than incandescent bulbs such as in the range of approximately 10,000-20,000 hours, but provide less desirable color emission. In comparison, LEDs can have lifetimes between 50,000 and 70,000 hours. The increased efficiency and extended lifetime of LEDs is attractive to many lighting suppliers and has resulted in LED light sources being used in place of conventional lighting in many different applications. It is predicted that further improvements will result in their general acceptance in more and more lighting applications. An increase in the adoption of LEDs in place of incandescent or fluorescent lighting would result in increased lighting efficiency and significant energy saving.

LED components or lamps have been developed that comprise an array of multiple LED packages mounted to a (PCB), substrate or submount. The array of LED packages can comprise groups of LED packages emitting different colors, and specular reflector systems to reflect light emitted by the LED chips. Some of these LED components are arranged to produce a white light combination of the light emitted by the different LED chips.

In order to generate a desired output color, it is sometimes necessary to mix colors of light which are more easily produced using common semiconductor systems. Because of the physical arrangement of the various source elements, multicolor sources often cast shadows with color separation and provide an output with poor color uniformity. Thus, one challenge associated with multicolor light sources is good spatial color mixing over the entire range of viewing angles. One known approach to the problem of color mixing is to use a diffuser to scatter light from the various sources.

Many current luminaire designs utilize forward-facing LED components with a specular reflector disposed behind the LEDs. One design challenge associated with multi-source luminaires is blending the light from LED sources within the luminaire so that the individual sources are not visible to an observer. Heavily diffusive elements are also used to mix the color spectra from the various sources to achieve a uniform output color profile. To blend the sources and aid in color mixing, heavily diffusive exit windows have been used. However, transmission through such heavily diffusive materials causes significant optical loss.

Some recent designs have incorporated light sources or light engines utilizing an indirect lighting scheme in which the LEDs or other sources are aimed in a direction other than the intended emission direction. This may be done to encourage the light to interact with internal elements, such as diffusers, for example. One example of an indirect fixture can be found in U.S. Pat. No. 7,722,220 to van de Ven which is commonly assigned with the present application.

There have also been recent designs that focus more on retrofitting or redesigning existing troffer-style light fixtures in order to utilize LEDs as a light source. This allows manufacturers to use existing manufacturing capabilities to produce troffer housings for LEDs, which is thought to help in reducing overall troffer costs. In some of these fixtures, hundreds of LED packages are mounted to the surface of an existing troffer pan to essentially cover the troffer pan surface with emitters, sometimes utilizing up to 400 LED packages. The emitters are then driven with a relatively low electrical signal so that the fixture gives a relatively uniform output with no visible hot spots.

Troffer-style light fixtures are typically provided with a prismatic lens or diffuser over the troffer pan/housing opening that faces the room to be illuminated. The prismatic diffuser is included to disperse some of the light from the source. Despite the use of hundreds of LED packages in an effort to spread the light evenly, these LED fixtures can still exhibit multiple emission hot spots as the light passes through the prismatic diffuser, producing an undesirable output. These fixtures having hundreds of LED packages can be relatively expensive, with the bulk of the expense being the LED packages, along with the cost and complexity of mounting, interconnecting, and driving the LED packages.

SUMMARY OF THE INVENTION

Embodiments of a light fixture comprise the following elements. A fixture housing defines an open end. A back surface is in the housing opposite the open end. At least one functional louver is between the back surface and the open end, the functional louver comprising side reflective surfaces and a mount surface facing toward the back surface. At least one light source is on the mount surface.

Embodiments of a light fixture comprise the following elements. A fixture housing defines an open end. A back surface is in the housing opposite the open end. At least one functional louver and at least one optical louver are arranged in a grid between the back surface and the open end. A plurality of light emitting LEDs is arranged on the functional louvers and faces the back surface.

Embodiments of a louver for light fixtures comprise the following elements. First and second reflective side surfaces are angled to meet at a vertex. A mount surface extends between the two ends of the side reflective surfaces opposite the vertex, the mount surface comprising notches for receiving a light source attachment.

BRIEF DESCRIPTION OF THE DRAWINGS

FIG. 1 is a bottom side perspective view of a fixture according to an embodiment of the present invention.

FIG. 2 is a bottom angle perspective view of a fixture according to an embodiment of the present invention.

FIG. 3 is a bottom angle perspective view of a set of louvers that may be used in an embodiment of the present invention.

FIG. 6 is a close-up top side angle perspective view of a portion of a functional louver that may be used in an embodiment of the present invention.

FIG. 9 is a cross-sectional view of a functional louver that may be used in an embodiment of the present invention.

DETAILED DESCRIPTION OF THE INVENTION

Figure 4:
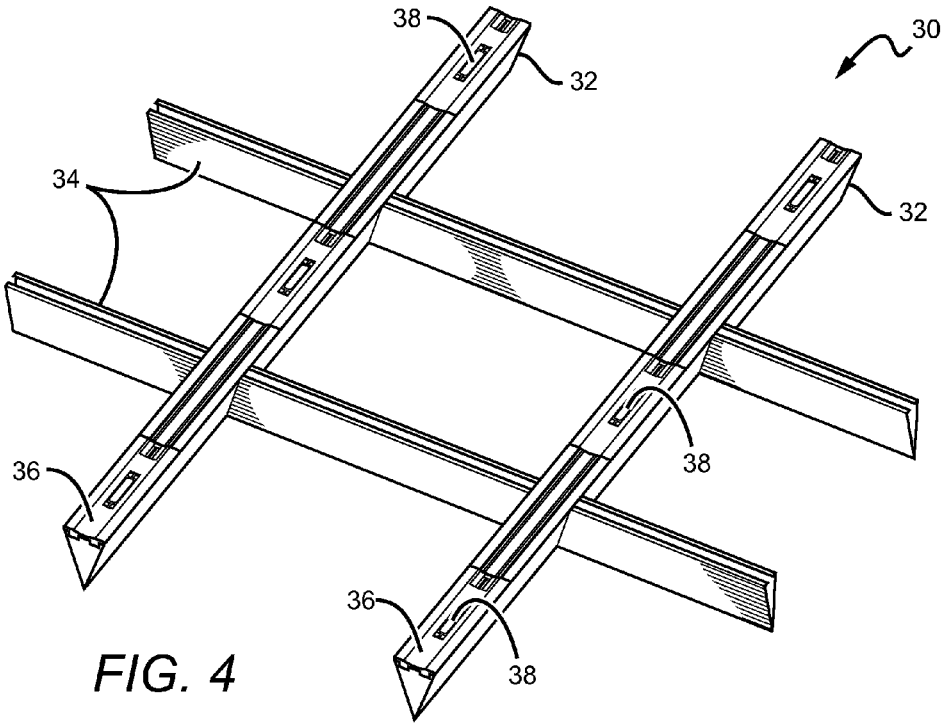
FIG. 4 is a top angle perspective view of a set of louvers that may be used in an embodiment of the present invention.

The present invention is directed to light fixtures with the embodiments described herein directed to troffer-style fixtures that are particularly well-suited for use with solid state light sources, such as LEDs or LED packages.

The present invention can also be used with many different types of lighting fixtures and housings, but are particularly applicable to troffer-style fixture of different sizes such as those having a 2 foot by 2 foot troffer opening. The embodiments of the present invention can also be used in troffer-fixtures having a 1 foot by 4 foot, or 2 foot by 4 foot troffer opening, or any other suitable dimension.

The invention is described herein with reference to certain embodiments, but it is understood that the invention can be embodied in many different forms and should not be construed as limited to the embodiments set forth herein. In particular, the present invention is described below in regards to troffer-style light fixtures, but it is understood that it is applicable to many other lighting styles, types and applications. The fixtures can have LEDs or LED packages arranged in many different arrays having different shapes and different numbers of LEDs or LED packages. Many different commercially available LEDs can be used in the lighting fixtures according to the present invention such as those commercially available from Cree, Inc., including but not limited to, XLamp® XP-E LEDs or XLamp® XP-G LEDs.

It is understood that when an element is referred to as being "on" another element, it can be directly on the other element or intervening elements may also be present. Furthermore, relative terms such as "inner", "outer", "upper", "above", "lower", "beneath", and "below", and similar terms, may be used herein to describe a relationship of one element to another. It is understood that these terms are intended to encompass different orientations of the device in addition to the orientation depicted in the figures.

Although the terms first, second, etc., may be used herein to describe various elements, components, regions and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the present invention.

As used herein, the term "source" can be used to indicate a single light emitter or more than one light emitter functioning as a single source. Thus, the term "source" should not be construed as a limitation indicating either a single-element or a multi-element configuration unless clearly stated otherwise. For example, the lighting fixtures described herein as having a solid state light source, can comprise light sources having a single-element or multi-element configuration.

The term "color" as used herein with reference to light is meant to describe light having a characteristic average wavelength; it is not meant to limit the light to a single wavelength. Thus, light of a particular color (e.g., green, red, blue, yellow, etc.) includes a range of wavelengths that are grouped around a particular average wavelength.

Embodiments of the invention are described herein with reference to view illustrations. The actual thickness, angles or orientations of the elements can be different, and variations from the shapes of the illustrations as a result, for example, of manufacturing techniques and/or tolerances are expected. Thus, the elements illustrated in the figures are schematic in nature and their shapes are not intended to illustrate the precise shape of a region of feature of an embodiment and are not intended to limit the scope of the invention.

FIGS. 1 and 2 show light fixtures 10, 20 according to embodiments of the present invention that can be used in many different applications. In the embodiments shown a troffer-style light fixture is sized to fit in, mount to, or suspend from a ceiling, such as being mounted in a conventional ceiling "T-grid." The fixtures 10, 20 are similar and share many of the same elements as denoted by common reference numbers. The fixture 10 comprises a troffer housing 12 sized to fit in or rest on the T-grid, with the housing 12 having a shape and size similar to the pans used for conventional fluorescent-type troffer lighting fixtures. The fixtures 10, 20 comprise a plurality of reflective louvers 14 arranged in a grid that divides the fixture open end into a number of fixture regions. One difference between the fixtures 10, 20 is the number of louvers used and, consequently, the number of fixture regions. Different numbers of louvers can be used, and many different grid arrangements are possible.

The housing 12 may be constructed out of many sturdy materials, with some suitable materials being aluminum and cold rolled steel, and may be sized to accommodate many different lighting designs. In many cases, the housing 12 may be sized to fit within existing light fixture spaces such that the new light fixtures can be installed with a retrofit kit.

The fixtures 10, 20 comprise a back surface 16 on the housing opposite the open end. The back surface 16 can be linear, curved, or both, and can comprise a single continuous surface or multiple discreet surfaces. The back surface 16 defines a luminous surface, which is any surface that functions as an apparent light source from the perspective of an observer in the lighted area. The back surface 16 may comprise many different materials. For many indoor lighting applications, it is desirable to present a uniform, soft light source without unpleasant glare, color striping, or hot spots. Thus, the back surface 16 may comprise a diffuse white reflector such as a microcellular polyethylene terephthalate (MCPET) material or a DuPont/WhiteOptics material, for example. Other white diffuse reflective materials can also be used. The back surface 16 may also be coated with a diffuse white reflective paint.

Diffuse reflective coatings have the inherent capability to mix light from solid state light sources having different spectra (i.e., different colors). These coatings are particularly well-suited for multi-source designs where two different spectra are mixed to produce a desired output color point. For example, LEDs emitting red light may be used in combination with LEDs emitting yellow (or blue-shifted yellow, "BSY") light to yield a white light output. A diffuse reflective coating may eliminate the need for additional spatial color-mixing schemes that can introduce lossy elements into the system; although, in some embodiments it may be desirable to use a diffuse luminous surface in combination with other diffusive elements. In some embodiments, the luminous surface may be coated with a phosphor material that converts the wavelength of at least some of the light from the light emitting diodes to achieve a light output of the desired color point.

By using a diffuse white reflective material for the back surface 16 and by positioning the light sources to emit first toward the back surface 16, either directly or indirectly, several design goals are achieved. For example, the back surface 16 performs a color-mixing function, significantly increasing both the mixing distance and the surface area of the source. Additionally, the surface luminance is modified from bright, uncomfortable point sources to a much larger, softer diffuse reflection. A diffuse white material also provides a uniform luminous appearance in the output. Harsh surface luminance gradients (max/min ratios of 10:1 or greater) that would typically require significant effort and heavy diffusers in a traditional direct view optic can be managed with much less aggressive (and lower light loss) diffusers achieving max/min ratios of 5:1, 3:1, or even 2:1.

The back surface 16 can comprise materials other than diffuse reflectors. In other embodiments, the back surface 16 can comprise a specular reflective material or a material that is partially diffuse reflective and partially specular reflective. In some embodiments, it may be desirable to use a specular material in one area and a diffuse material in another area. Many combinations are possible.

FIG. 3 is a perspective bottom side view of a louver grid 30 that may be used in fixtures according to embodiments of the present invention. The removable grid 30 is shown separate from the housing for illustration. In this embodiment, the grid 30 comprises functional louvers and optical louvers 34. The functional louvers (discussed in more detail herein) include a top side mount surface 36 and are designed for heat dissipation. Light sources are disposed on the mount surface and, thus, are in good thermal contact with the functional louver. In this regard, the functional louvers 32 serve as heat sinks, providing a thermal pathway from the light sources to the ambient environment. Because the optical louvers 34 do not have to carry any light sources, they may constructed with less material such that they are lighter and cost less. However, it is possible to utilize the optical louvers as additional heat dissipaters. This particular embodiment comprises two functional louvers 32 and two optical louvers arranged in an orthogonal grid 30 defining nine distinct regions. However, it is understood that different numbers of functional and optical louvers 32, 34 may be used to create many different grid designs.

FIG. 4 is a top side perspective view of the louver grid 30. Several light sources 38 are disposed along the mount surfaces 36 of the functional louvers 32. In this embodiment, the optical louvers 34 do not support any light sources; they function as traditional louver elements to redirect light downward and to provide mechanical cutoff for observers in the room area.

The fixture 10 can also comprise a system or mechanism to provide electrical power to the light sources which can comprise a conventional power supply or ballast having various components and circuitry. Some of these can include an AC/DC converter and one or more DC/DC converters. Conventional power supplies can comprise large and costly components, and can also require setting of the output drive signal to provide the desired light engine light emission. The setting is typically done at the factory during light engine fabrication.

The troffer-style fixture 10 can also comprise a system or mechanism to distribute electrical power to the each light source 38. In the embodiment shown, a DC signal from an AC/DC converter can be distributed to the various light sources. The DC signal can be distributed in many different ways, such as through a wiring harness or through printed circuit boards (PCBs). The wiring harness or PCBs can run along different portions of the fixture and/or the louvers and can have a connector arrangement for connecting to the electrical power to the light sources 38.

Each light source 38 can have its own DC/DC converter that can be on-board or adjacent the light source 38, that converts signal from the DC output to the appropriate DC level to drive the LEDs on the light source 38. Each of the DC/DC converters can have additional circuitry to provide other functions, such as compensating and dimming circuitry. These are only a couple of the many functions that can be provided along with the DC/DC converter.

Having respective DC/DC converters at each light source 38 can provide certain advantages. In conventional troffers having the AC/DC and DC/DC converters in one power supply can require setting of the output of the power supply at the factory to match it to the light engine of the particular troffer. Thus, if this type of combined power supply malfunctions or fails it can result in complex repair procedures or replacement of the entire troffer or light engine. By having the DC/DC converter at each light source, the AC/DC converter does not need to be set at the factory. A failed or malfunctioning AC/DC converter can be easily replaced in the field. If an on-board DC/DC converter malfunctions or fails at the light source, the light source can be removed and replaced with a functioning lighting source. The DC/DC converter on the light source will have been set to the desired level for that particular light source, so the repair procedure does not require resetting in the field.

Furthermore, the components for a combined AC/DC and DC/DC converters that drive the entire fixture can also be large and expensive. By making the DC/DC converter on-board and remote at each light source 38, smaller and less expensive components can be used because of the reduced power needed from each converter. A DC/DC converter for the entire fixture would need to accommodate 40 watts of power, or more. By dividing that load into multiple portions, the individual light source need only see 5 watts. This allows for many of the DC/DC circuit components to be consolidated into purpose-build integrated circuits, reducing cost and size.

The remote DC/DC converters can also be arranged closer to the light sources which can provide for greater driving efficiency and control.

Figure 5:
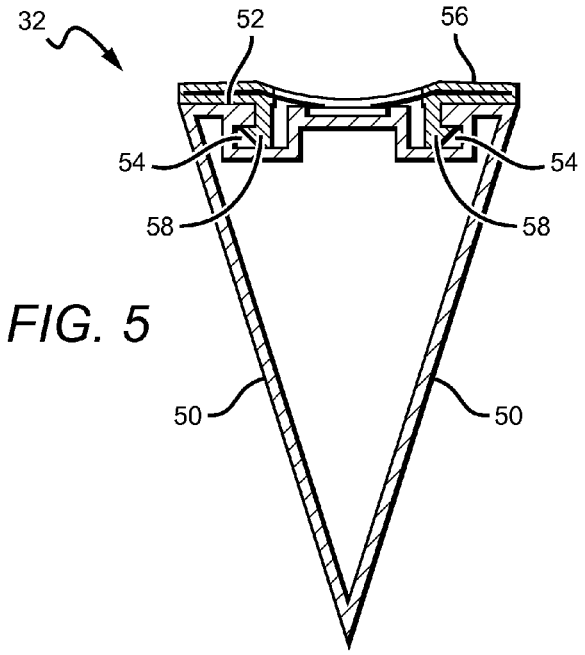
FIG. 5 is a cross-sectional view of a functional louver that may be used in an embodiment of the present invention.

FIG. 5 is a top side perspective view of a portion of a functional louver 32 that may be used in fixtures disclosed herein. FIG. 6 is a cross-sectional view of the functional louver 32. The functional louver 32 comprises two side reflective surfaces 50 angled to meet at a vertex. In the embodiment shown, the side reflective surfaces 50 are linear; however, in other embodiments the side reflective surfaces 50 may be curved (e.g., parabolic), linear, or piecewise linear. A top side mount surface 52 extends between the two side reflective surfaces 50 providing a substantially planar area on which to dispose light sources. This particular embodiment comprises notches 54 in the mount surface for attaching a structure such as a light strip or a retention clip. This particular embodiment comprises a retention clip 56 that is fastened to the mount surface 52 with a pair of flanges 58 that mate with the notches 54. The flanges 58 can hold the retention clip 56 in place while a thermal epoxy cures to fasten the retention clip 56 to the mount surface 52, or the flanges may provide enough mechanical force to hold the retention clip 56 in place without the use of an epoxy. In embodiments using only the flanges 58, thermal grease may be used to facilitate heat dissipation from the retention clip 58 to the louver 32.

The louver 32 may be substantially hollow as shown. A hollow core provides a high surface-to-weight ratio which encourages heat dissipation from the louver 32 into the ambient while at the same time providing a lighter structure for mounting within a fixture. In some embodiments, it may be desirable to mount various structures within the louver 32 such as wires, electronic components, or active cooling devices, for example.

FIG. 6 shows a perspective view from a top side angle of the louver 32. In this embodiment, an LED chip-on-board (COB) type light source 60 is on the mount surface 52 of the louver 32. LEDs are centralized under an encapsulant in given area using a linear COB configuration. A voltage is applied to the COB element 60 by attaching a power source (not shown) to the power pad 62. Multiple COB elements can be connected in series along the louver mount surface as shown in FIG. 4.

Figure 7:
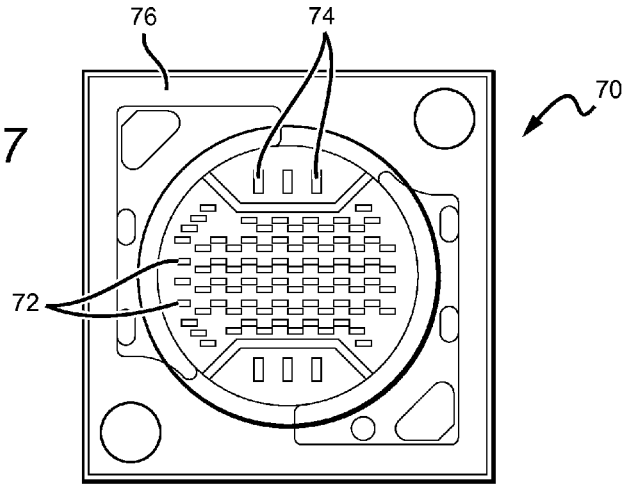
FIG. 7 is a top perspective view of a chip-on-board element that may be used in an embodiment of the present invention.

FIG. 7 is a top perspective view of a COB element 70 that may be used in fixtures according to embodiments of the present invention. The COB element 70 has a square footprint, whereas the COB element 60 has an elongated rectangular footprint. The COB element 70 comprises several LEDs of first color 72 and LEDs of a second color 74 all mounted to a thermally conductive board 76. On-board elements provide circuitry that can power multiple high voltage LEDs. The element 70 may be easily mounted to the mount surface within the fixture. COB elements provide several advantages over traditional individually packaged LEDs. One advantage is the removal of a thermal interface from between the chip and the ambient environment. A substrate element, which may be made of alumina or aluminum nitride, may be removed as well resulting in a cost saving. Process cost may also be reduced as the singulation process necessary to separate individual LED dice is eliminated from the work stream.

In some embodiments, including those with a COB element, a multicolor source is used to produce the desired light emission, such as white light, and several colored light combinations can be used to yield white light. For example, as discussed in U.S. Pat. Nos. 7,213,940 and 7,768,192, both of which are assigned to Cree, Inc., and both of which are incorporated herein by reference, it is known in the art to combine light from a blue LED with wavelength-converted yellow light to yield white light with correlated color temperature (CCT) in the range between 5000K to 7000K (often designated as "cool white"). Both blue and yellow light can be generated with a blue emitter by surrounding the emitter with phosphors that are optically responsive to the blue light. When excited, the phosphors emit yellow light which then combines with the blue light to make white. In this scheme, because the blue light is emitted in a narrow spectral range it is called saturated light. The yellow light is emitted in a much broader spectral range and, thus, is called unsaturated light.

Another example of generating white light with a multicolor source comprises combining the light from green and red LEDs. RGB schemes may also be used to generate various colors of light. In some applications, an amber emitter is added for an RGBA combination. The previous combinations are exemplary; it is understood that many different color combinations may be used in embodiments of the present invention. Several of these possible color combinations are discussed in detail in U.S. Pat. No. 7,213,940 to van de Ven et al.

Other light sources can comprise a series of clusters having two blue-shifted-yellow LEDs ("BSY") and a single red LED ("R"). BSY refers to a color created when blue LED light is wavelength-converted by a yellow phosphor. The resulting output is a yellow-green color that lies off the black body curve. BSY and red light, when properly mixed, combine to yield light having a "warm white" appearance. These and other color combinations are described in detail in the previously incorporated patents to van de Ven (U.S. Pat. Nos. 7,213,940 and 7,768,192). The light sources according to the present invention can use a series of clusters having two BSY LEDs and two red LEDs that can yield a warm white output when sufficiently mixed.

The light sources can be arranged to emit relatively even emission with different luminous flux, with some embodiments having light sources that combine to emit at least 100 lumens, while other embodiments can emit at least 200 lumens. In still other embodiments the lighting sources can be arranged to emit at least 500 lumens.

Figure 8A:
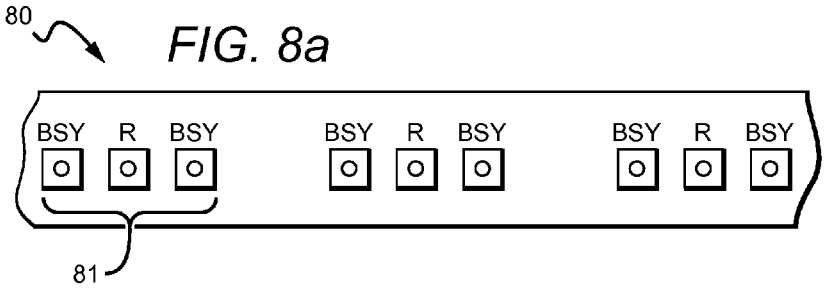
FIGS. 8*a-c* show top schematic views of several light strips that may be used in an embodiment of the present invention.
Figure 8B:
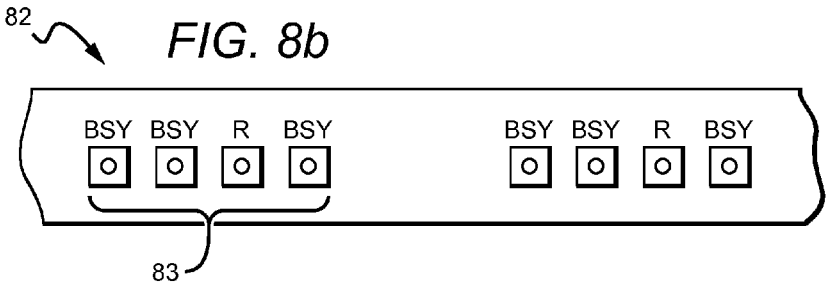
Figure 8C:
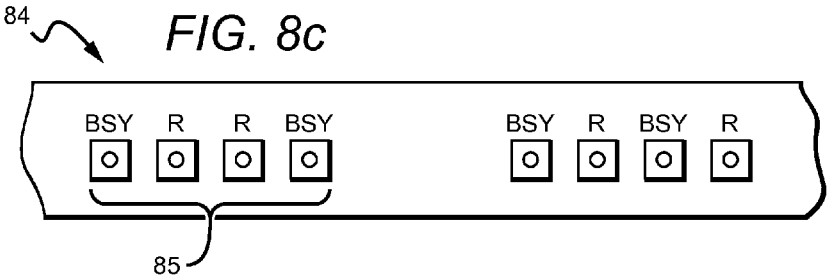

In several of the fixture embodiments described herein, the light sources are arranged on light strips which may be disposed on the mount surface 52. FIGS. 8*a-c* show a top schematic view of portions of several light strips 80, 82, 84 that may be used to mount multiple LEDs to the mount surface 52. Although LEDs may be used as the light sources in various embodiments described herein, it is understood that other light sources, such as laser diodes for example, may be substituted in as the light sources in other embodiments of the present invention.

The lighting strips 80, 82, 84 each represent possible LED combinations that result in an output spectrum that can be mixed to generate white light. Each lighting strip can include the electronics and interconnections necessary to power the LEDs. In some embodiments the lighting strip comprises a printed circuit board with the LEDs mounted and interconnected thereon. The lighting strip 80 includes clusters 81 of discrete LEDs, with each LED within the cluster 81 spaced a distance from the next LED, and each cluster 81 spaced a distance from the next cluster 81. If the LEDs within a cluster are spaced at too great distance from one another, the colors of the individual sources may become visible, causing unwanted color-striping.

The scheme shown in FIG. 8*a* uses a series of clusters 81 having two blue-shifted-yellow LEDs ("BSY") and a single red LED ("R"). Once properly mixed the resultant output light will have a "warm white" appearance.

The lighting strip 82 includes clusters 83 of discrete LEDs. The scheme shown in FIG. 8*b* uses a series of clusters 83 having three BSY LEDs and a single red LED. This scheme will also yield a warm white output when sufficiently mixed.

The lighting strip 84 includes clusters 85 of discrete LEDs. The scheme shown in FIG. 8*c* uses a series of clusters 85 having two BSY LEDs and two red LEDs. This scheme will also yield a warm white output when sufficiently mixed.

The lighting schemes shown in FIGS. 8*a-c* are meant to be exemplary. Thus, it is understood that many different LED combinations can be used in concert with known conversion techniques to generate a desired output light color.

FIG. 9 is a cross-sectional view of the functional louver 32. Many modern applications require high voltage light sources for increased output and brightness. This embodiment comprises a high voltage LED 90. In such applications, a transmissive cover 92 may function as a flame barrier (e.g., glass or a UL94 5VA rated transparent plastic) which is required to cover high voltage light sources. Centrally located LED clusters reduce cost as the material necessary for the flame barrier cover 92 is reduced. If high voltage LEDs are used, then an economically efficient high voltage (boost) power supply may be used. The cover 90 may also function as a lens to shape/convert/diffuse the light as it emanates from the sources but before it interacts with the back reflector. Any of these optional elements or any combination of these elements may be used in functional louvers designed for embodiments of the lighting fixtures disclosed herein.

It is understood that embodiments presented herein are meant to be exemplary. Embodiments of the present invention can comprise any combination of compatible features shown in the various figures, and these embodiments should not be limited to those expressly illustrated and discussed.

Although the present invention has been described in detail with reference to certain preferred configurations thereof, other versions are possible. Therefore, the spirit and scope of the invention should not be limited to the versions described above.

We claim:

1. A light fixture, comprising:
- a fixture housing defining an open end;
- a back surface in said housing opposite said open end;
- at least one functional louver between said back surface and said open end, said functional louver comprising side reflective surfaces and a mount surface facing toward said back surface;
- at least one light source on said mount surface; and
- a retention clip on said mount surface, wherein said retention clip is configured to mate with one or more features on said mount surface.

2. The light fixture of claim 1, further comprising a plurality of louvers in a grid between said back surface and said open end.

3. The light fixture of claim 2, wherein said plurality of louvers comprises functional louvers and optical louvers, said optical louvers comprising side reflective surfaces.

4. The light fixture of claim 1, said back surface comprising a diffuse reflective surface.

5. The light fixture of claim 1, wherein said at least one light source comprises at least one cluster of light emitting diodes (LEDs) on said mount surface.

6. The light fixture of claim 1, wherein said at least one light source comprises at least one cluster of LEDs, each of said clusters comprising at least one red LED and at least one blue-shifted yellow (BSY) LED.

7. The light fixture of claim 1, wherein said at least one light source comprises at least one chip-on-board LED element.

8. The light fixture of claim 1, wherein said at least one light source comprises an LED light strip.

9. The light fixture of claim 1, wherein said at least one functional louver has a hollow core.

10. A light fixture, comprising:
- a fixture housing defining an open end;
- a back surface in said housing opposite said open end;
- at least one functional louver between said back surface and said open end, said functional louver comprising side reflective surfaces and a mount surface facing toward said back surface;
- at least one light source on said mount surface; and
- a retention clip on said mount surface, wherein said at least one light source is on said retention clip.

11. The light fixture of claim 1, wherein said retention clip mates with notches in said mount surface.

12. The light fixture of claim 1, wherein said retention clip comprises a recessed central portion along a longitudinal direction.

13. The light fixture of claim 1, further comprising a lens over said at least one light source on said mount surface.

14. The light fixture of claim 1, further comprising a flame barrier over said at least one light source on said mount surface.

15. A light fixture, comprising:
- a fixture housing defining an open end;
- a back surface in said housing opposite said open end;
- at least one functional louver comprising reflective side surfaces and at least one optical louver in a grid between said back surface and said open end; and
- a plurality of light emitting diodes (LEDs) on said at least one functional louver in which emitting surfaces of said plurality of LEDs are emitting toward said back surface of said housing, wherein a portion of said functional louver opposite said emitting surfaces of said plurality of LEDs is hollow.

16. The light fixture of claim 15, wherein said functional louvers comprise a mount surface facing said back surface.

17. The light fixture of claim 15, said back surface comprising a diffuse reflective surface.

18. The light fixture of claim 16, wherein said plurality of LEDs comprises at least one LED cluster on said mount surface.

19. The light fixture of claim 18, wherein said at least one cluster of LEDs comprises at least one red LED and at least one blue-shifted yellow (BSY) LED.

20. The light fixture of claim 15, wherein said plurality of LEDs comprises at least one chip-on-board LED element.

21. The light fixture of claim 15, wherein said plurality of LEDs comprises an LED light strip.

22. The light fixture of claim 15, wherein said at least one functional louver has a hollow core.

23. The light fixture of claim 16, further comprising a retention clip on said mount surface, said plurality of LEDs on said retention clip.

24. The light fixture of claim 23, wherein said retention clip mates with notches in said mount surface.

25. The light fixture of claim 23, wherein said retention clip comprises a recessed central portion along a longitudinal direction.

26. The light fixture of claim 16, further comprising a lens over said plurality of LEDs on said mount surface.

27. The light fixture of claim 16, further comprising a flame barrier over said plurality of LEDs on said mount surface.

* * * * *